US005558489A

United States Patent [19]

Moncrief et al.

[11] Patent Number: 5,558,489

[45] Date of Patent: Sep. 24, 1996

[54] MASS FEEDER FOR PRODUCT DELIVERY SYSTEM

[75] Inventors: Frank Moncrief, Acworth; David R. Bacco, Canton, both of Ga.; Charles McNamara, Tucson, Ariz.; Dwight L. Smith, Kennesaw; Colin Ford, Woodstock, both of Ga.

[73] Assignee: Riverwood International Corporation, Atlanta, Ga.

[21] Appl. No.: 418,100

[22] Filed: Apr. 6, 1995

[51] Int. Cl.[6] ..... B65H 29/36

[52] U.S. Cl. ..... 414/793.7; 414/795.8; 414/331

[58] Field of Search ..... 414/795.8, 793.4, 414/793.7, 331; 271/157, 149

[56] References Cited

U.S. PATENT DOCUMENTS

| | | | |
|---|---|---|---|
| 3,240,488 | 3/1966 | Lyman | 271/149 |
| 3,591,018 | 6/1971 | Nalbach | 414/793.7 |
| 4,618,054 | 10/1986 | Muller | 271/157 |
| 4,950,120 | 8/1990 | Barnes | 414/331 |
| 5,154,315 | 10/1992 | Dominico et al. | 414/795.8 |
| 5,211,529 | 5/1993 | Esala et al. | 271/157 |
| 5,245,547 | 9/1993 | Ramsey | 271/149 |
| 5,413,323 | 5/1995 | Imbert et al. | 271/149 |

FOREIGN PATENT DOCUMENTS 2409275 8/1975 Germany .

*Primary Examiner*—Karen B. Merritt
*Assistant Examiner*—Douglas Hess
*Attorney, Agent, or Firm*—Hopkins & Thomas

[57] ABSTRACT

A partition feeder has a multi-rack assembly for holding more than one reserve stack of partitions. The partition feeder has a main stack of partitions which is forced against a set of tabs and which has its partitions removed by a selecting apparatus. When the main stack has been reduced down past a certain amount, one of the reserve stacks is automatically moved into alignment with the main stack and the partitions in the reserve stack are added to the main stack. The partition feeder has guide rails that are received in notched sides of the partitions, thereby suspending the partitions on the guide rails. An inner frame, upon which the guide rails are mounted, is adjustably mounted to a middle frame to thereby permit the adjustment of the distance between the guide rails. The middle frame is adjustably mounted to an outer frame to permit the vertical adjustment of the mass feeder. The partition feeder can therefore be easily adjusted for partitions of different sizes.

31 Claims, 10 Drawing Sheets

MASS FEEDER FOR PRODUCT DELIVERY SYSTEM

FIELD OF THE INVENTION

The invention generally relates to a system for delivering a plurality of products and, more particularly, to a system that delivers a number of partitions which are to be positioned between beverage containing articles.

BACKGROUND OF THE INVENTION

When packaging articles, such as bottles or cans, into a carton or other suitable container, the articles are typically separated into discrete groups and each group of articles is then placed into a carton. Frequently, an insert or partition is placed between the articles to prevent the articles from colliding into each other and causing damage to the integrity of the articles or damage to the graphics on the articles. The partitions may serve other functions as well, such as forming part of the carton. The partitions are placed between the articles after the articles have been separated into a discrete group but before the articles are placed into the cartons.

In a typical packaging machine, a partition feeder holds a stack of the partitions in a supply hopper. The stack of partitions are formed between two sides of the supply hopper and rest against the bottom of the hopper. The stack is releasably retained within the supply hopper by a set of tabs which contacts the first partition in the stack. The stack of partitions are biased toward the tabs by either the weight of the stack and/or by a pusher or other similar type of mechanism which pushes the rear end of the stack.

A selecting apparatus typically has a set of vacuum cups which move forwardly against the first partition and then move away from the partition feeder in order to remove the one partition from the stack. The tabs are carefully positioned so that they permit the removal of the first partition by the vacuum cups but prevent the other partitions from being removed along with the first partition. After removing the partition, the selecting apparatus releases the partition from the vacuum cups and places the partition between adjacent articles in a discrete group.

The ability of the selecting apparatus to pick a single partition is influenced by a number of factors, including the extent to which the tabs contact the partitions, the pressure in the vacuum cups, and the force applied through the partitions to the tabs. With many partition feeders, the stack is formed at a downward angle so that the weight of the stack itself generates a force at the tabs. This force is necessary to ensure that subsequent partitions are advanced into the proper position after previous partitions have been removed by the selecting apparatus. The force is also necessary so that vacuum cups in the selecting apparatus do not knock the partitions out of position when they move against the first partition for a pick. The magnitudes of the pressure in the cups, the force at the tabs, and the amount of tabbing must be fairly accurately set in order for the selecting apparatus to consistently and reliably remove a single partition from the supply hopper.

The advancement of the partitions, however, may be hampered by the supply hopper. For instance, the surfaces of the sides and bottom of the supply hopper frictionally engage the partitions rendering it difficult for the partitions to advance. At times, a gap forms between adjacent partitions due to one partition advancing at a different rate than the other partition. These gaps disrupt the order of the stack and affect the magnitude of the force applied by the stack against the tabs. Also, during the refilling of the supply hopper, the partitions may fall down so that the fronts of the partitions face the bottom of the supply hopper. It was therefore difficult with existing supply hoppers to ensure that the partitions remain in alignment with each other.

The supply hopper may present additional problems. Due to the friction generated by the sides and bottom of the supply hopper, a relatively large force must be used to overcome the frictional engagement of the supply hopper. This relatively large force, in turn, requires that the tabbing be heavy, i.e. must extend further into the partitions, and that the pressure in the cups be large so that a partition can be removed from the heavy tabbing. Because the partitions are being subjected to a heavy tabbing and a large pressure, the partitions must be strong enough so that they do not tear or otherwise become damaged. The packaging machines are therefore limited in the types of partitions that can be used in the cartons.

In order to maintain a sufficient force at the tabs, the weight of the stack should not fall below a certain amount. Consequently, during operation of the partition feeder, an operator must periodically refill the partition feeder so that the stack stays above this certain amount. When the packaging machine operates at faster rates, the partition feeder must be more closely supervised by the operator since the partitions are removed from the supply hopper at a quicker rate. A need therefore exists in the industry for a partition feeder which requires less supervision and which is therefore less labor intensive.

The partition feeders are typically mounted above the flow of articles, with the supply hopper being about 7 or 8 feet above the ground. The operators of the partition feeder therefore need a step ladder or some type of raised platform with steps in order for the operator to add the partitions to the supply hopper. The time and energy expended by the operator in going up and down the steps further burdens the operator and results in an overall more costly packaging operation.

Many packaging machines can only package one size of articles and just one configuration of articles. For instance, a packaging machine might be limited to just a standard American size bottle that is packaged into a 12 pack container. Another packaging machine would be designed to package articles having a different size article or to package articles into a different size container.

Some recently manufactured packaging machines, however, have some flexibility in that they can package articles of different sizes into various types of containers. While these machines may have the capability, it is relatively difficult to adjust the packaging machines to package another article size or another configuration. The adjustments necessary on the packaging machines include an adjustment in the partition feeder for a different size partition. This adjustment might encompass the replacement of one supply hopper with a supply hopper that could hold the new partitions. A need therefore exists in the industry for a partition feeder that can supply partitions of different sizes.

SUMMARY OF THE INVENTION

The invention, in one aspect, comprises a mass feeder that has a pair of side rails for forming a main stack of products. The mass feeder has at least one tab at one end of the side rails for contacting an end product in the main stack. A number of reserve stacks of products are formed such that the reserve stacks are spaced above each other with a top reserve stack being aligned with the main stack of products. The mass feeder has a first pusher for advancing the main stack toward the tab and has a second pusher for adding the top reserve stack to the main stack. A controller in the mass feeder removes the first pusher from contact with the main stack when the top reserve stack approaches the main stack and thereafter causes the second pusher to advance the main stack toward the tab after the products in the top reserve stack have been added to the main stack.

The invention, in a second aspect, comprises an apparatus for forming a main stack of products and for forcing the products against a set of tabs at one end of the stack. The apparatus forms at least one reserve stack of products and moves the reserve stack into alignment with the main stack at an end of the stack opposite the end with the tabs when the main stack has been reduced down to a predetermined amount.

The invention, in a third aspect, comprises a multi-rack assembly for forming reserve stacks of products. The multi-rack assembly has a first drive unit with a pair of vertically spaced paddles and a second drive unit with another pair of vertically spaced paddles. The paddles on the two drive units are vertically spaced the same distance and are spaced apart from a corresponding paddle on the other drive unit a distance sufficient to form a first reserve stack between the upper paddles and a second reserve stack between the lower paddles. A controller generates a control signal when additional products are needed in a main stack and also causes the drive units to simultaneously raise the bottom paddles into alignment with guide rails forming the main stack. In this manner, the reserve stacks of products may be added to the main stack when additional products are needed in the main stack.

The invention, in a fourth aspect, comprises a multi-rack assembly for forming reserve stacks of products having a left drive unit for rotating a first set of paddles about a periphery of the first drive unit in a counter-clockwise direction and a right drive unit for rotating a second set of paddles in a clockwise direction about a periphery of the second drive unit. The paddles on the two drive units are aligned with each other such that the paddles on the interior sides of one drive unit are laterally spaced a distance from corresponding paddles on the interior side of the other drive unit, with the distance being sufficient to form a reserve stack of products between each laterally spaced pair of paddles. One of the laterally spaced pair of paddles is aligned with and parallel to a pair of guide rails which form a main stack of products. A controller drives the first and second motors in synchronism with each other so as to move the one pair of laterally spaced paddles out of alignment with the guide rails and to move a second pair of laterally spaced paddles into alignment with the rails when the main stack of products has been reduced down a certain amount.

The invention, in a fifth aspect, comprises a partition feeder for use with partitions having notched sides. The partition feeder has first and second spaced apart guide rails for respectively receiving the notched sides of the partitions and for forming a main stack of the partitions. At least one tab is placed at one end of the guide rails for contacting one end of the stack and a selecting apparatus removes the partitions from the one end against contact with the tab. The partitions are biased toward the one end of the guide rails. The guide rails suspend the partitions and allow the partitions to freely advance toward the one end of the guide rails.

The invention, in a sixth aspect, comprises an adjustable frame for a partition feeder which forms a main stack of partitions between first and second side rails. A first frame mounts at least a part of the feeder at a specific location relative to a flow of articles and has first and second walls spaced apart from each other a fixed distance. A second frame has first and second plates positioned between the first and second walls with the first and second side rails being respectively mounted to the first and second plates. The first and second plates are mounted to the first and second walls in a manner which allows the first and second plates to travel between the two walls. The distance between the first and second plates can be adjusted to thereby adjust the distance between the first and second side rails to correspond to a width of the partitions.

The invention, in a seventh aspect, comprises an adjustable frame for a partition feeder which forms a main stack of partitions between first and second side rails. A first frame is mounted at a predetermined height above a flow of articles and a second frame has at least the side rails of the feeder mounted thereon. The second frame is attached to the first frame in a manner which allows the second frame to be raised or lowered with respect to the first frame so as to place the second frame at a desired distance from the first frame. The distance between the first frame and the side rails can therefore be adjusted to correspond to a height of the partitions.

DETAILED DESCRIPTION OF THE PREFERRED EMBODIMENTS

Figure 1:
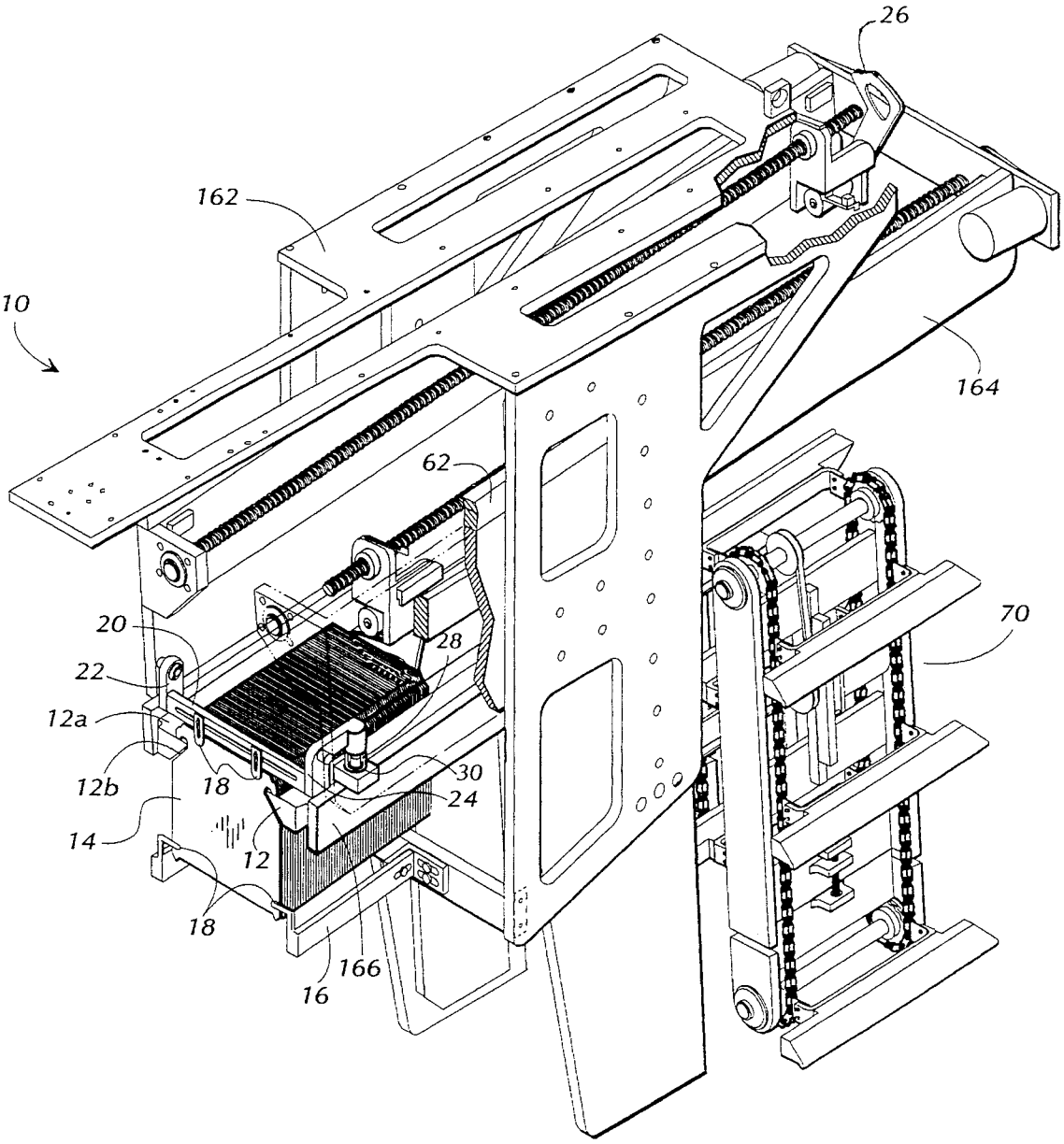
FIG. 1 is a front perspective view of a mass feeder according to the preferred embodiment of the invention.

With reference to FIG. 1, a preferred embodiment of a partition feeder 10 has a pair of guide rails 12 extending along a longitudinal length of the feeder 10. Each guide rail 12 is generally wedge-shaped with a generally planar top surface 12*a* and an angled side surface 12*b*. A stack of partitions 14 have notched sides for mating with the wedge-shaped guide rails 12, with the generally planar top surface 12*a* of the guide rails 12 supporting the partitions 14. The guide rails 12 form a stack of partitions 14 along the length of the guide rails 12 with each partition 14 suspended upon the guide rails 12. The guide rails 12 are formed of a relatively low friction material, such as an ultra-high molecular weight (UHMW) plastic, which enables the partitions 14 to advance easily toward a set of tabs 18. The guide rails 12 are not limited to UHMW, but may be formed from any suitable material.

The guide rails 12 offer several advantages over the supply hopper of a conventional partition feeder. For one, an operator can easily load the partitions 14 by simply aligning the notched sides of the partitions 14 with the guide rails 12. The guide rails 12 ensure that the partitions 14 remain in alignment with each other in the stack since the partitions 14 cannot fall down or otherwise become disordered relative to the other partitions 14. Also, the guide rails 12 present a minimal amount of resistance to the partitions 14. Whereas before the partitions 14 would contact the sides and bottom of a supply hopper, the partitions 14 in the partition feeder 10 of the invention only contact the guide rails 12 at their notched sides.

In the embodiment shown, the partitions 14 are held within the stack by four tabs 18 respectively located at the four corners of the first partition 14. The bottom two tabs 18 are mounted to an outer frame 162 of the feeder 10 by adjustable brackets 16, which allow both horizontal and vertical adjustment of the tabs 18. The top two tabs 18 are adjustably mounted to a cross-bar 20 which has its two ends respectively affixed to a lever 22 and to a bell crank 24. The stack of partitions 14 is forced against the tabs 18 by a pusher 26 at the rear end of the stack.

The force supplied by the stack against the tabs 18 pushes the cross-bar 20 outwardly thereby rotating the bell crank 24 and lever 22. When the bell crank 24 rotates, the bell crank 24 compresses a urethane spring 28 having one end placed against a load bearing surface of a load cell 30. The force at the tabs 18 is therefore transferred through the cross-bar 20, bell crank 24, and urethane spring 28 before reaching the load cell 30. The control of the force at the tabs 18 by detecting the force with a load cell assembly is the subject matter of commonly-assigned U.S. patent application Ser. No. 08/404,225, filed on Mar. 15, 1995, entitled "Force Sensing Assembly and Method for a Product Delivery System."

Figure 2:
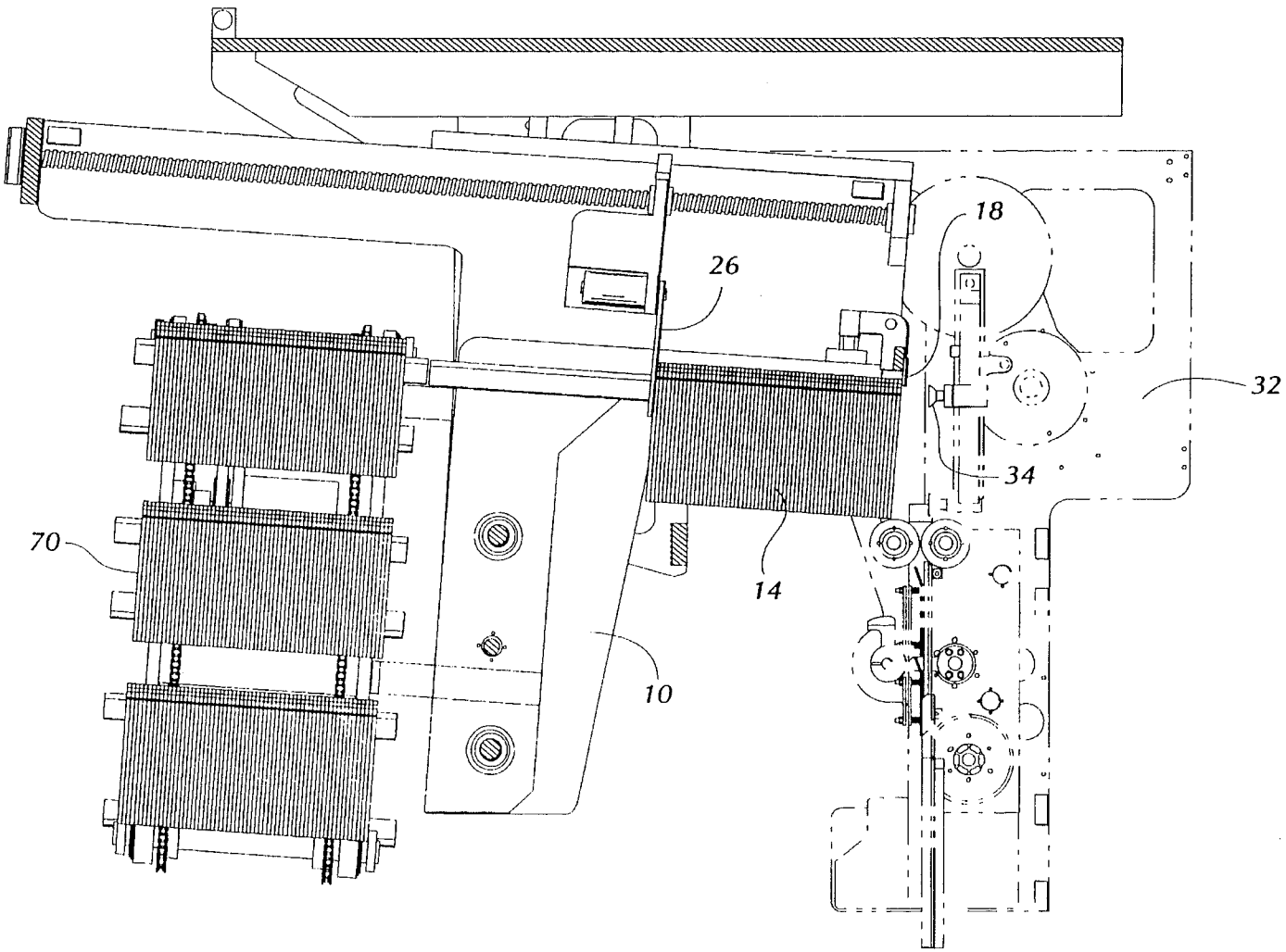
FIG. 2 is a partial side view of the mass feeder shown with a selecting apparatus.

A selecting apparatus 32, which is shown in FIG. 2, has a set of vacuum cups 34 to remove a partition 14 against contact from the tabs 18. Once a partition 14 is removed by the apparatus 32, the partition 14 is placed between a group of articles, such as bottles traveling below the selecting apparatus 32. The selecting apparatus 32 does not form any part of the present application and any suitable apparatus for removing a partition may be used. A preferred selecting apparatus 32, however, is disclosed in commonly-assigned U.S. patent application Ser. No. 08/418,101 filed on Apr. 6, 1995, entitled "Article Selection and Delivery Method and Apparatus."

Figure 3:
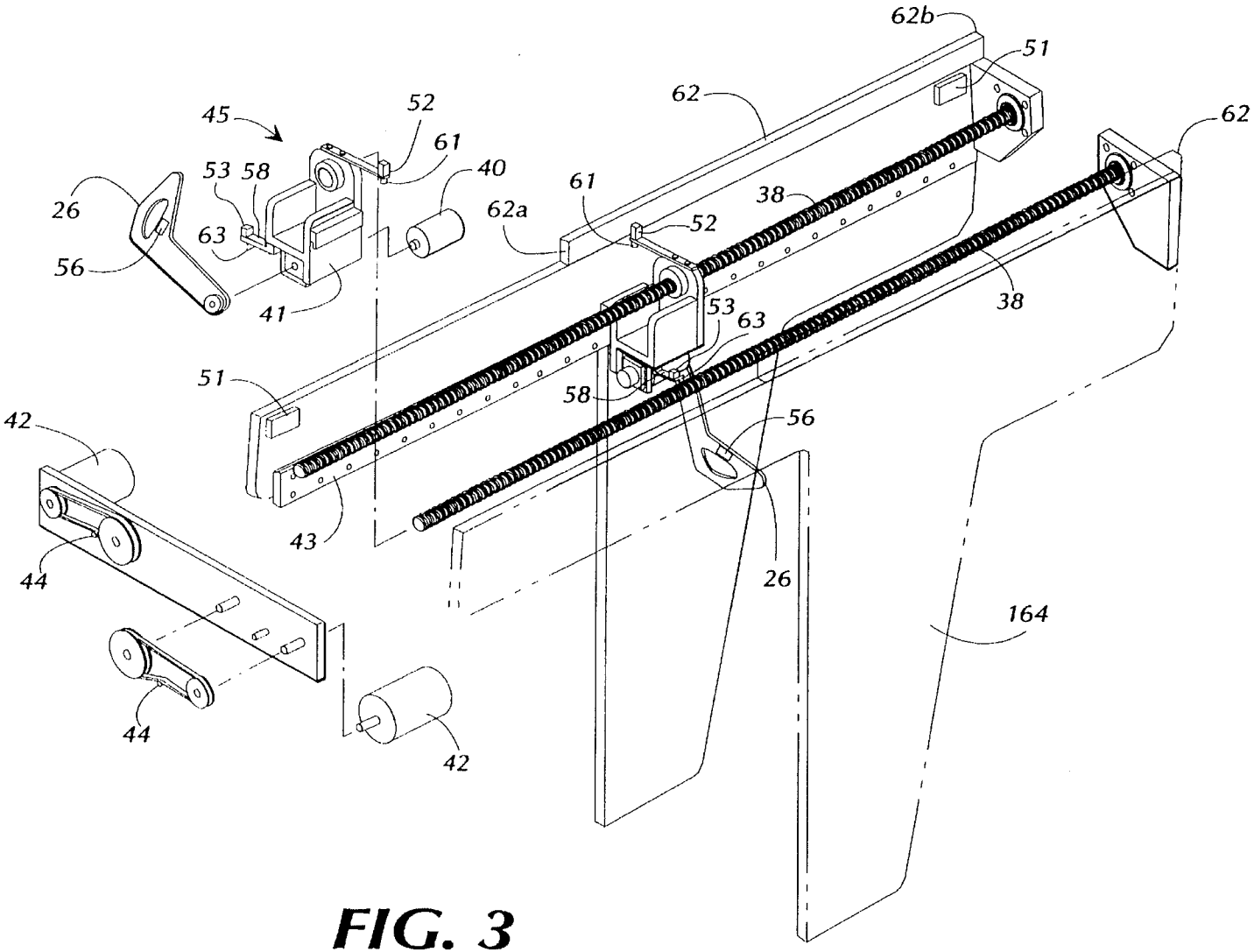
FIG. 3 is a partial rear perspective view of the mass feeder of FIG. 1.

As best seen in a rear cut-away view shown in FIG. 3, the partition feeder 10 has two screw drives 38 running along the length of the feeder 10. A pusher assembly 45, comprised of a rotary actuator 40 and a pusher 26, is connected to each screw drive 38 and has a bearing 41 for mounting the pusher assembly 45 to a linear guide 43 extending along the length of the feeder 10. The rotary actuators 40 lower and raise their respective pushers 26 in a manner that will be described in more detail below. A stepper motor 42 is connected to each screw drive 38 through a set of gears 44. By controlling the speed and direction of the stepper motors 42, the screw drives 38 can be rotated in either direction to move the pushers 26 toward or away from the tabs 18 and to move the pushers 26 at different speeds.

During operation of the pushers 26, only one pusher 26 at a time will be pushing a main stack of partitions 14 toward the tabs 18. At times, however, the other pusher 26 may be moving partitions 14 from a reserve stack toward the main stack and, consequently, toward the one pusher 26. It is therefore necessary to detect the various positions of the rotary actuator 40 and of the pusher 26 throughout the operation of the partition feeder 10.

Figure 7:
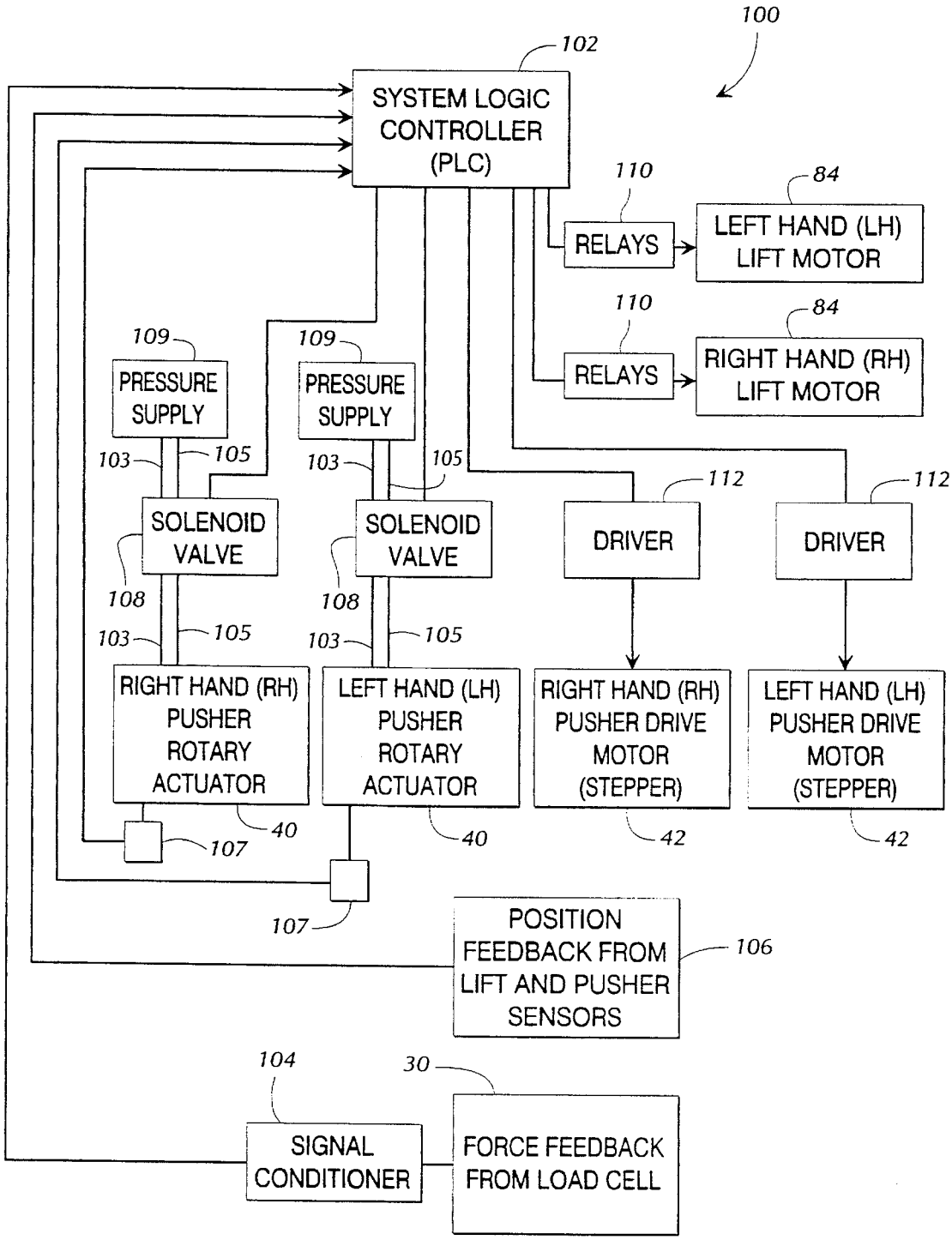
FIG. 7 is a block diagram of the mass feeder of FIG. 1.

The partition feeder 10 has a number of sensors for indicating the positions of the rotary actuator 40 and of the pusher 26. As best seen in FIG. 7, each rotary actuator 40 is connected to a first pneumatic line 103 for raising the pusher 26 and a second pneumatic line 105 for lowering the pusher 26. The pneumatic lines 103 and 105 are connected to a supply of pressure 109. While the position of the pusher 26 can be deduced from which pneumatic line 103 or 105 has been activated, each rotary actuator 40 is provided with two feedback sensors 107 for indicating whether its pusher 26 is in the raised position or whether the pusher 26 is in the lowered position.

As shown in FIG. 3, a first set of four proximity sensors 51 is mounted to a middle frame 164 of the partition feeder 10 at each end of both screw drives 38. The first proximity sensors 51 detect a metal flag 61, which in this example is a bolt 61 that mounts a second proximity sensor 52 to the pusher assembly 45. The first proximity sensor 51 therefore provides an indication as to whether the paddles 26 are at either end of the screw drives 38.

The second proximity sensor 52 is mounted at an upper portion of each pusher assembly 45 for detecting a metal ridge 62 that runs along a partial length of the partition feeder 10. The metal ridge 62 has a first end **62*a* at a predetermined point along the length of the screw drives 38 and has the other end 62*b* at the end of the screw drives 38 near the tabs 18. The second proximity sensor 52 provides an indication that the pusher 26 has moved past the predetermined point during its travel toward the tabs 18**. The significance of this predetermined point will be discussed in more detail below.

A third proximity sensor 53 is mounted to a horizontal bracket 58 on each pusher assembly 45. One of the brackets 58 has an upwardly extending metal flag 63 and has the third proximity sensor 53 mounted to the bottom of the bracket 58. The other bracket 58 has the flag 63 and third proximity sensor 53 placed in reverse positions, that is the flag 63 extends down from the bracket 58 and the third proximity sensor 53 is mounted on the top of the bracket 58. If the pushers 26 pass each other when traveling in opposite directions, the bottom mounted proximity sensor 53 of the one pusher 26 will detect the downwardly extending metal flag 63 on the other pusher 26 and the top mounted proximity sensor 53 of the other pusher 26 will detect the upwardly extending metal flag 63 on the one pusher 26. The third proximity sensors 53 allow each pusher assembly 45 to detect the approach of the other pusher assembly 45 so that the pushers 26 may be raised or lowered to prevent the pushers 26 from colliding into each other.

Each pusher 26 is mounted with a photoelectric eye ("photoeye") 56 which looks straight down to detect the approach of additional partitions 14. As discussed above, as one pusher 26 is advancing the main stack of partitions 14 to the tabs 18, the other pusher 26 may be adding partitions 14 to the main stack. The photoeye 56 on the pusher 26 detects the arrival of the additional partitions 14 so that the pusher 26 may be raised to add the partitions 14 in the reserve stack to the main stack.

Figure 4:
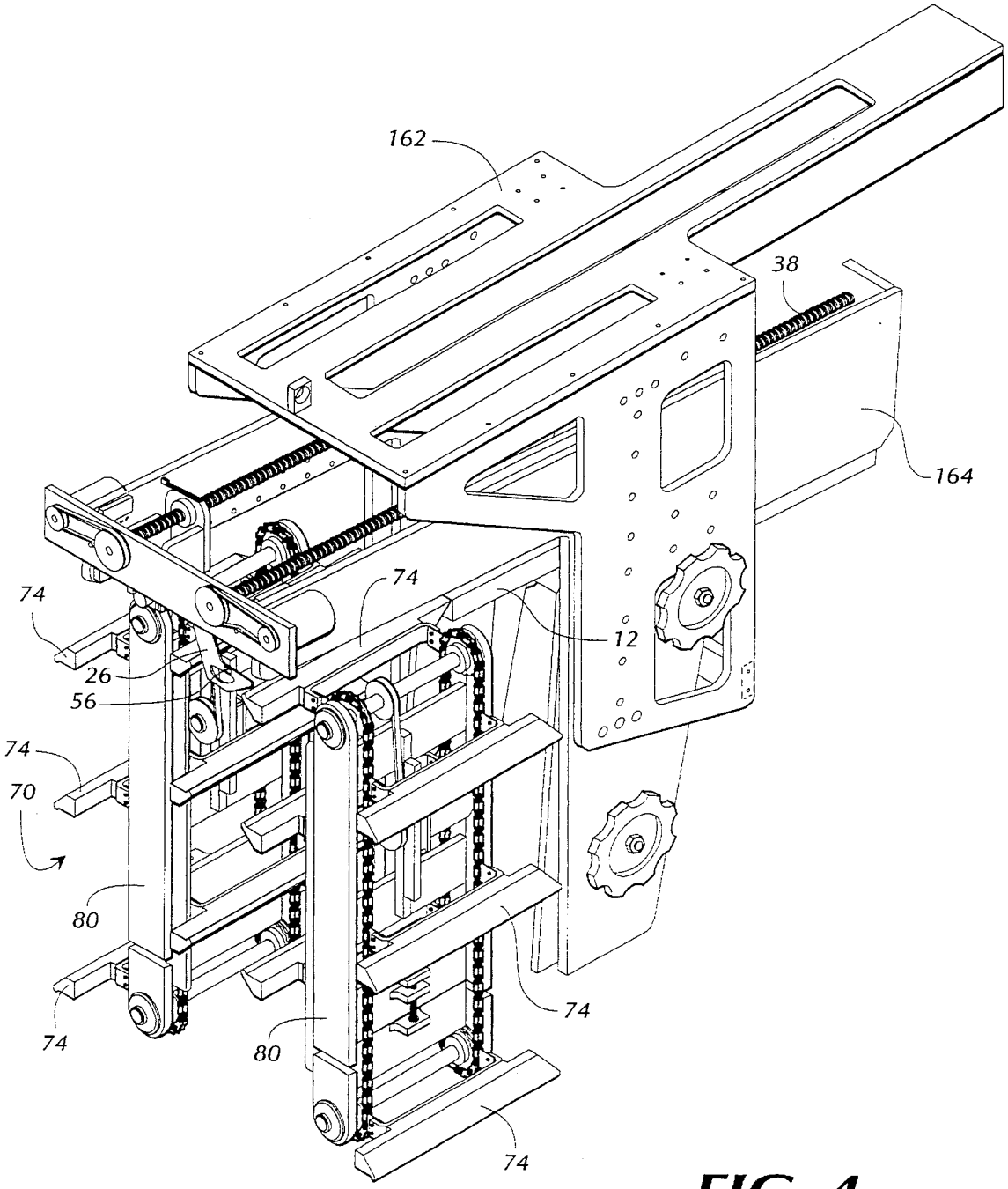
FIG. 4 is a rear perspective view of the mass feeder of FIG. 1.

As best seen in FIGS. 3 and 4, the partition feeder 10 has a multi-rack assembly 70 for holding three reserve stacks 72 of partitions 14 between pairs of opposing paddles 74. The three reserve stacks 72 are vertically spaced from each other with the paddles 74 forming the top stack 72a being aligned with the guide rails 12 forming the main stack of partitions 14. Two photoeyes 76 detect whether partitions 14 are present in the lower two reserve stacks 72*b* and 72*c*. When the main stack has diminished past a predetermined amount, which occurs when the second proximity sensor 52 on the rotary actuator 40 detects the metal ridge 62, the paddles 74 may be rotated to advance a reserve stack 72 of partitions 14 into alignment with the main stack.

Figure 6:
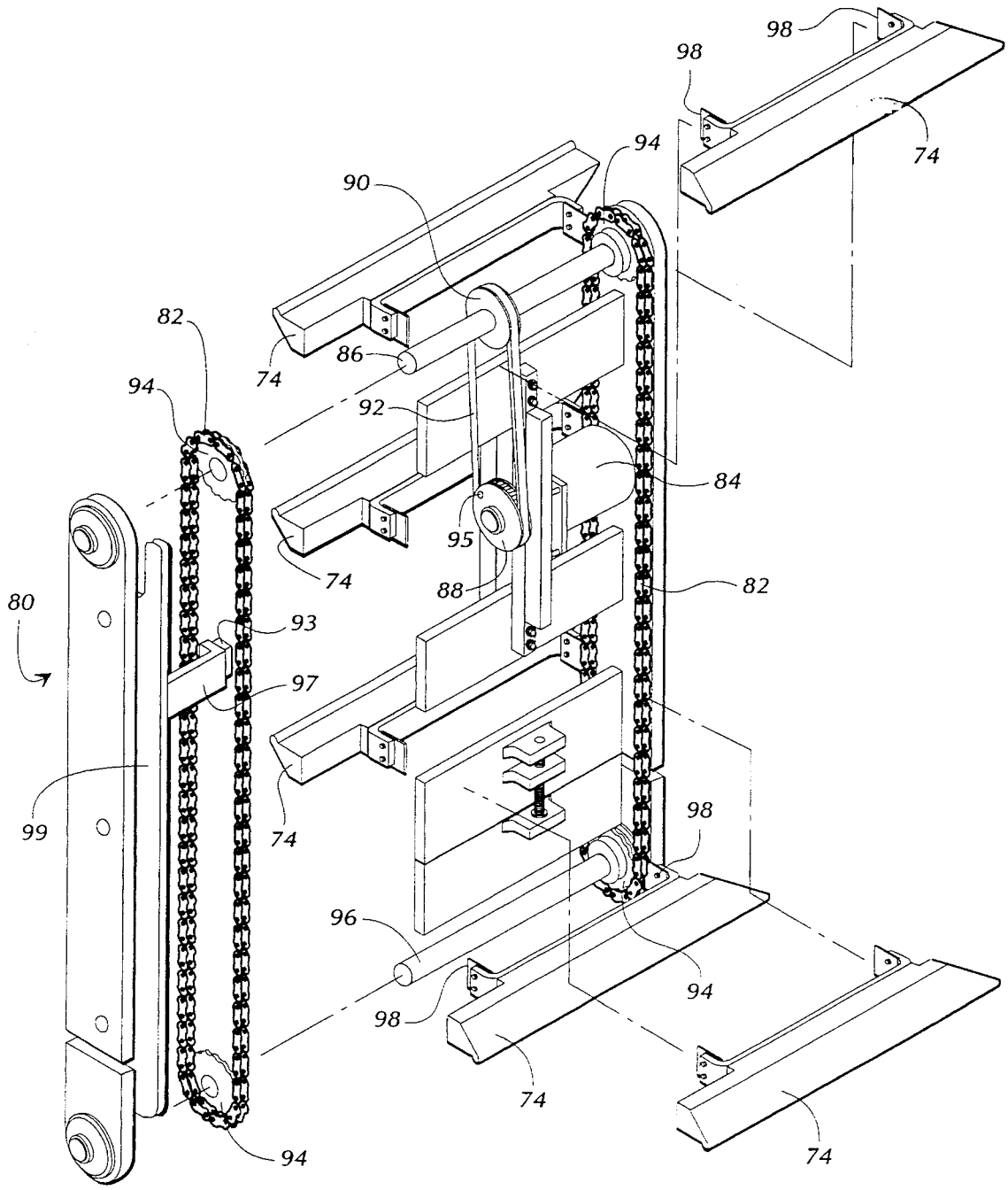
FIG. 6 is an exploded view of a drive unit in a multi-rack assembly.

The multi-rack assembly 70 is comprised of two drive units 80 with six paddles 74 mounted to chains 82 of each drive unit 80. As best seen in FIG. 6, each drive unit 80 has a synchronous lift motor 84 for rotating a drive shaft 86 through a first pulley 88, a second pulley 90 on the drive shaft 86, and a belt 92 interconnecting the two pulleys 88 and 90. Sprockets 94 are located at both ends of the drive shaft 86 and at both ends of a second shaft 96 located near the bottom of the drive unit 80. The pair of chains 82 link the sprockets 94 on the drive shaft 86 to the sprockets 94 on the bottom shaft 96. Brackets 98 on the paddles 74 mount the paddles 74 to the chains 82 at equal intervals along the length of the chains 82.

Figure 5:
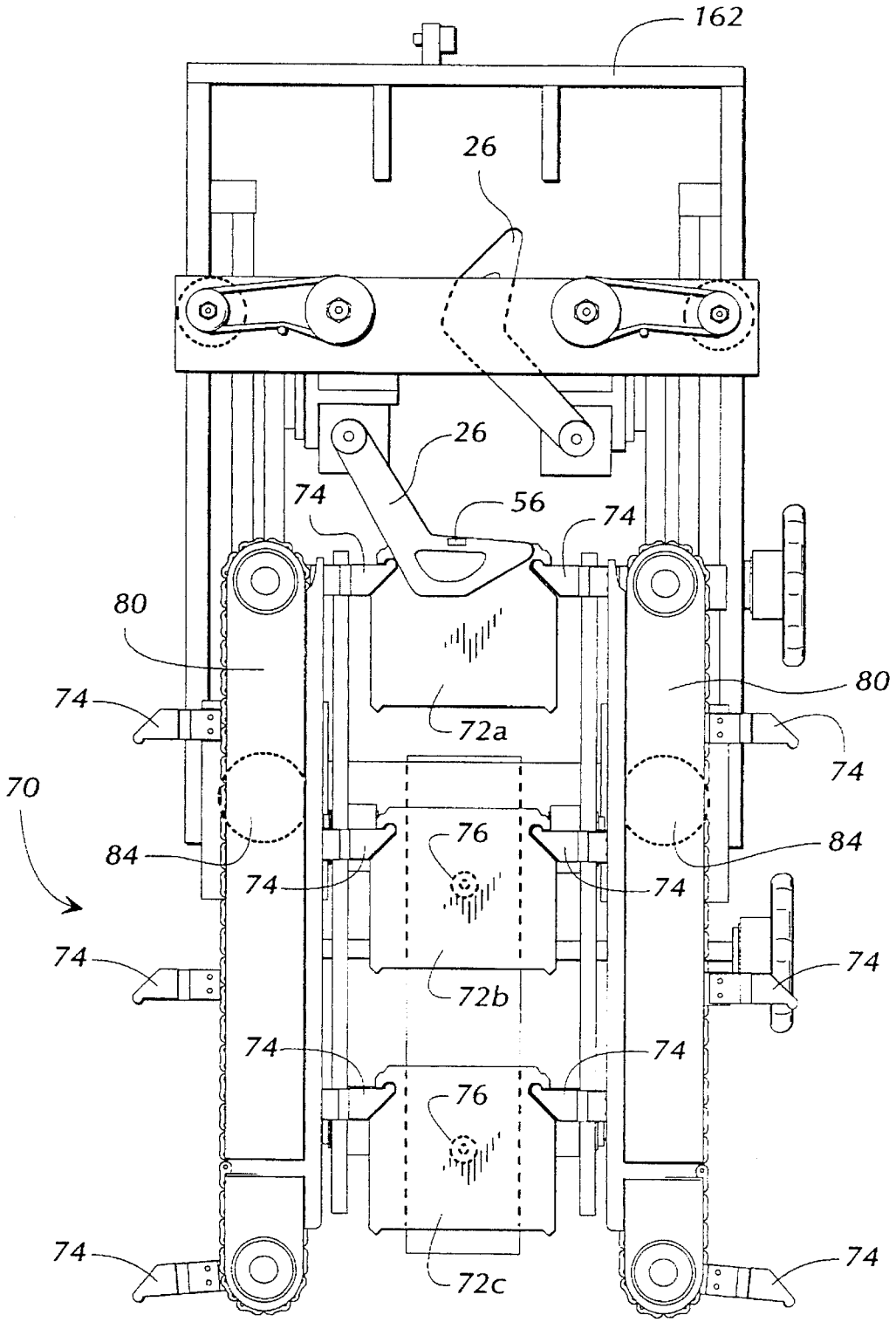
FIG. 5 is a rear end view of the mass feeder of FIG. 1.

A proximity sensor 93 is positioned between the first pulley 88 and the chain 82 and a metal flag 95 is affixed to a surface of the pulley 88 that faces away from the motor 84. The proximity sensor 93, which is secured to a bracket 97 attached to one of two chain guards 99, faces the pulley 88 and detects the metal flag 95 upon each full rotation of the pulley 88. The lift motors 84 are driven in opposite directions and in synchronism with each other so as to advance the partitions 14 in the reserve stacks 72 up toward the guide rails 12. Thus, in the view shown in FIG. 5, the left motor 84 rotates the paddles 74 in a counter-clockwise direction while the right motor 84 rotates the paddles 74 in a clockwise direction. The circumference of the pulley 88 is designed to equal the distance between paddles 74 so that one full rotation of the pulley 88 will advance the paddles 74 to the next position.

The position of the paddles 74 may be sensed in ways other than with the sensor 93 and the flag 95. For instance, a flag may be affixed to one side of each bracket 98. As the paddles 74 are being rotated about the drive unit 80, a proximity sensor would detect the flag on one of the paddles 74 when the top paddle 74 becomes aligned with the guide rails 12. The proximity sensor may be positioned to detect the top paddle 74 or may be positioned to detect the relative position of one of the other paddles 74.

A block diagram of the partition feeder control system 100 is shown in FIG. 7. A programmable logic controller (PLC) 102 controls the operations of the entire system 100. In the preferred embodiment, the PLC 102 is an Allen-Bradley Model No. PLC 5. It should be understood that the invention is not limited to a PLC 102 but rather may be embodied with other types of controllers.

The signals from the load cell 30 are processed by a signal conditioner 104 and then supplied to the PLC 102 to indicate the amount of force at the tabs 18. The signal conditioner 104 converts the non-linear output of the load cell 30 into a linear 4 to 20 mA signal. The signal conditioner 104 could alternatively supply a linear 0 to 10 volt signal or an indexed signal to the PLC 102. The PLC 102 adjusts the speed and position of the pusher 26 based upon the magnitude of the force at the tabs 18.

For instance, if a desired force at the tabs 18 is 3 lbs. and if the force at the tabs 18 is less than 1 lb., the PLC 102 advances the pusher 26 at a high speed toward the tabs 18 to thereby increase the force. If the force is above 1 lb. but below 2 lbs., the PLC 102 advances the pusher 26 at a low speed toward the tabs 18. The PLC 102 stops the pusher 26 at a force of 3 lbs., which is the desired force at the tabs 18. When the force exceeds 4.5 lbs., the pusher 26 is moved away from the tabs 18 at a low speed.

While the invention is preferably used in conjunction with the load cell 30 and related force sensing assembly, the force at the tabs 18 may be controlled in other manners. For instance, the stack of partitions 14 may instead abut against a limit switch which informs the PLC 102 whether the first partition 14 is in position for a pick. When the limit switch does not detect the end partition, the PLC 102 advances the pusher 26 until the partition 14 depresses a plunger in the limit switch. Other variations in the control of the pushers 26 will be apparent to those skilled in the art.

The PLC 102 receives the position feedback from the lift and pusher sensors 106. These sensors include the first 51, second 52, and third 53 proximity sensors relating to the position of the pusher 26, the sensors 107 indicating whether the pusher 26 is raised or lowered, the photoeyes 56 on the pushers 26 for detecting partitions 14 from an approaching reserve stack 72, the photoeyes 76 on the multi-rack assembly 70 for detecting the presence of the lower two reserve stacks 72*b* and 72*c* of partitions 14, and the proximity sensors 93 for detecting a full revolution of the pulleys 88 in the drive units 80.

The PLC 102 is also connected to the various valves and motors in the partition feeder 10. For instance, through solenoid valves 108, pneumatic lines 103 and 105, and pressure supplies 109, the PLC 102 controls rotary actuators 40 for positioning the pushers 26 in either the raised or lowered position. To advance a reserve stack 72 of partitions 14 into alignment with the main stack, the PLC 102 sends signals to relays for driving the left and right synchronous lift motors 80. The PLC 102 supplies signals to the left and right stepper motors 42 through respective drivers 112 for controlling the screw drives 38 and for thereby controlling the positions of the pushers 26 along the length of the feeder 10.

The PLC 102 executes a number of routines for controlling the operations of the partition feeder 10. While the PLC 102 repeatedly executes each of these routines in a sequential fashion, the PLC 102 could instead or additionally be programmed to have interrupts. Also, although the PLC 102 is the preferred controller, the operations of the partition feeder 10 could be controlled by another type of device, such as a computer system.

Figure 8:
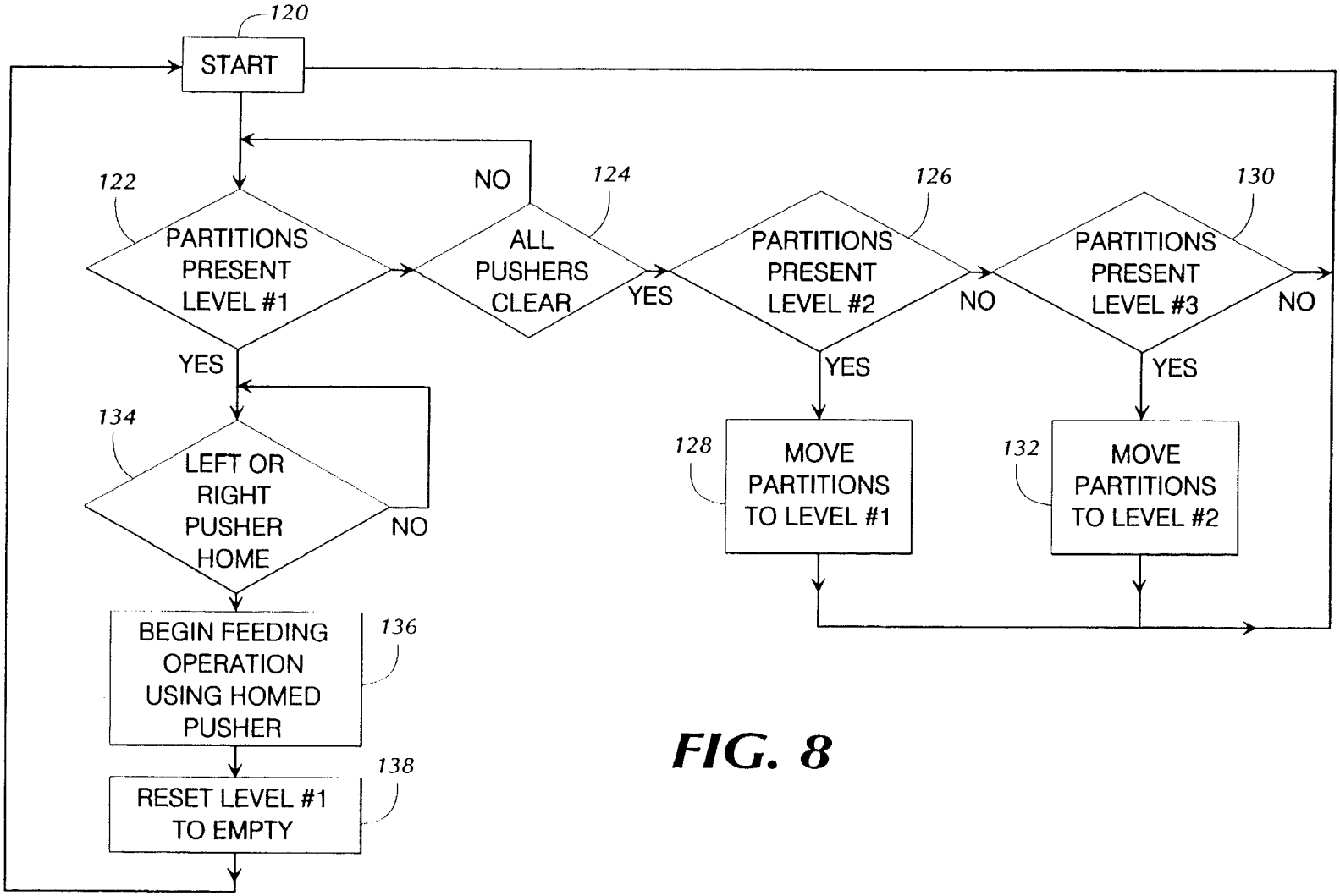
FIG. 8 is a flow chart of a routine for controlling the multi-rack assembly.

A routine executed by the PLC 102 for controlling the lift operation and initiating a pusher cycle is depicted in a flow chart in FIG. 8. For the ease of description, the positions of the three reserve stacks 72 will hereinafter be referred to as levels 1 to 3, with level 1 being the location of the uppermost reserve stack 72*a* and level 3 being the location of the lowermost reserve stack 72. In this routine, at step 122 the PLC 102 first determines whether partitions 14 are present in level 1. If partitions 14 are not present in level 1, the PLC 102 determines at step 124 whether all of the pushers 26 are clear. The pushers 26 are all clear when the pushers 26 are at the home position, which is at the far end of the partition feeder 10 opposite the tabs 18, or are past the predetermined point along their travel toward the tabs 18.

With no partitions 14 in the level 1 and with all pushers 26 clear, the multi-rack assembly 70 is permitted to advance a reserve stack 72 up to level 1. Therefore, the PLC 102 then checks at step 126 whether partitions 14 are present in level 2, and, if so, drives the lift motors 84 at step 128 to raise the partitions 14 up to level 1 and the routine returns to start 120. If the partitions 14 are not present in level 2 but are present in level 3, as determined in step 130, the PLC 102 moves the partitions up to level 2 at step 132 and the routine returns to start 120.

If partitions 14 are present in level 1, the PLC 102 waits at step 134 until either the left or right pusher 26 is at the home position. With one of the pushers 26 at home and with partitions 14 present in level 1, the PLC 102 at step 136 adds the partitions 14 in level 1 to the main stack with the at-home pusher 26. Once the feeding operation for the partitions 14 in level 1 has begun, the PLC 102 resets level 1 to empty at step 148 and the routine returns to start 120.

Figure 9:
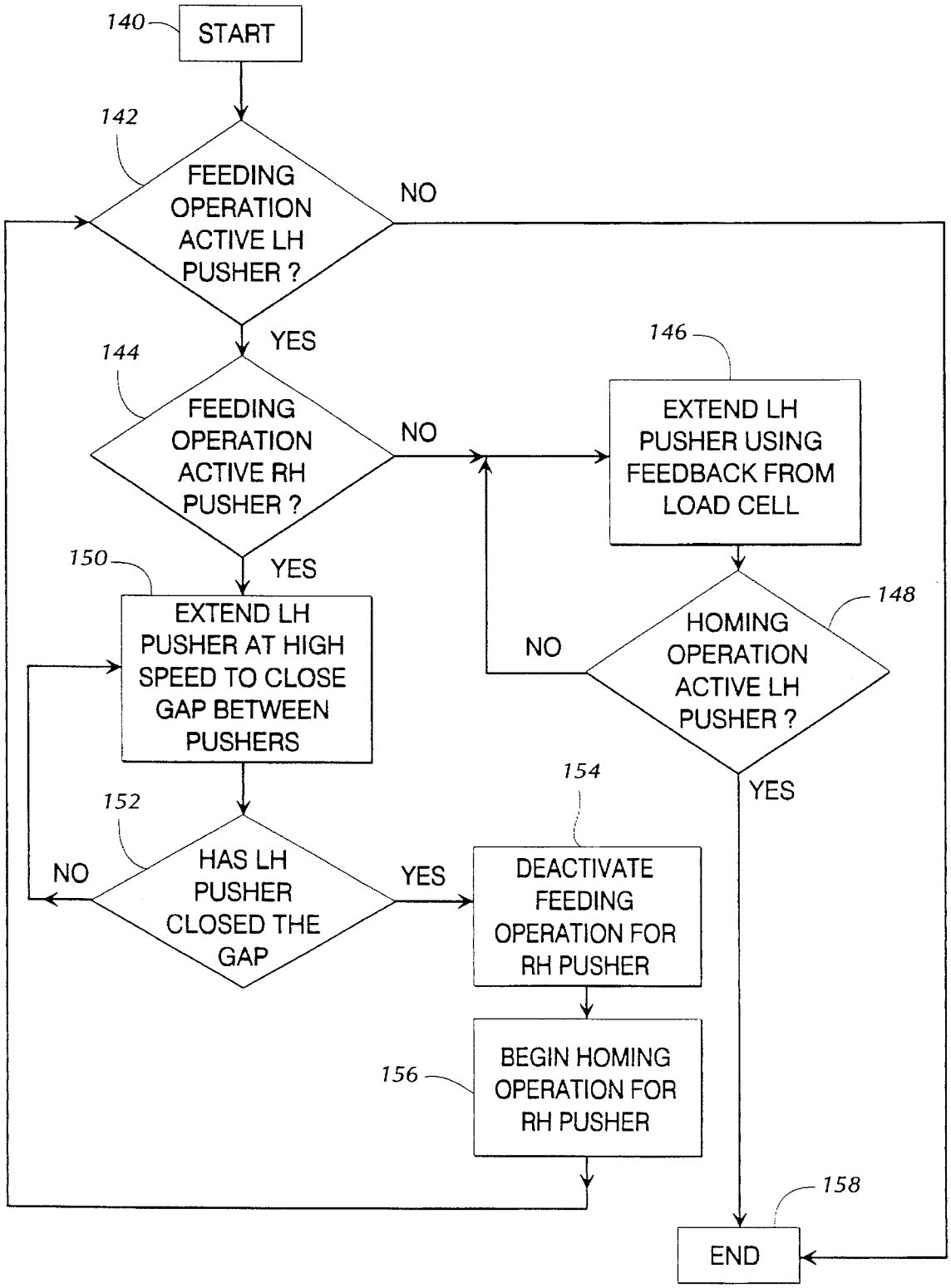
FIG. 9 is a flow chart of a routine for controlling a pusher.

A routine for controlling the operation of the feed cycle for the left pusher 26 is shown in FIG. 9. The operation of the right pusher 26 should be apparent from FIG. 9 and will therefore not be described in detail. With reference to FIG. 9, the PLC 102 determines at step 142 whether a feeding operation with the left pusher 26 is active and ends the routine at step 158 if it is not active.

On the other hand, if the left pusher 26 feeding operation is active, the PLC 102 next determines at step 144 whether the feeding operation is also active for the right pusher 26. If the right pusher 26 is not active, the left pusher 26 is controlled at step 146 using the feedback from the load cell 30 to maintain the force at the tabs 18 at an optimal value or within a range of values. Reference may be made to commonly-assigned U.S. patent application Ser. No. 08/404,225 for a full description of a routine executed by the PLC 102 for controlling the pusher 26. The left pusher 26 is controlled by the load cell 30 until, at step 148, a homing operation is active for the left pusher 26, at which time the left pusher 26 returns to the home position and the routine ends at step 158.

If the right pusher 26 is already active, at step 150 the PLC 102 advances the left pusher 26 at a high speed toward the right pusher 26 in order to close the gap between the two pushers 26. Once the gap has been closed, as determined at step 152, the photoeye 56 on the right pusher 26 will detect the approach of the partitions 14 advanced by the left pusher 26, control of the right pusher 26 will be deactivated at step 154, and the right pusher 26 will be sent to the home position at step 156. With the right pusher 26 removed and the left pusher 26 advancing the stack, the routine returns to the step 142 of checking whether the feeding operation is active for the left pusher 26.

Figure 10:
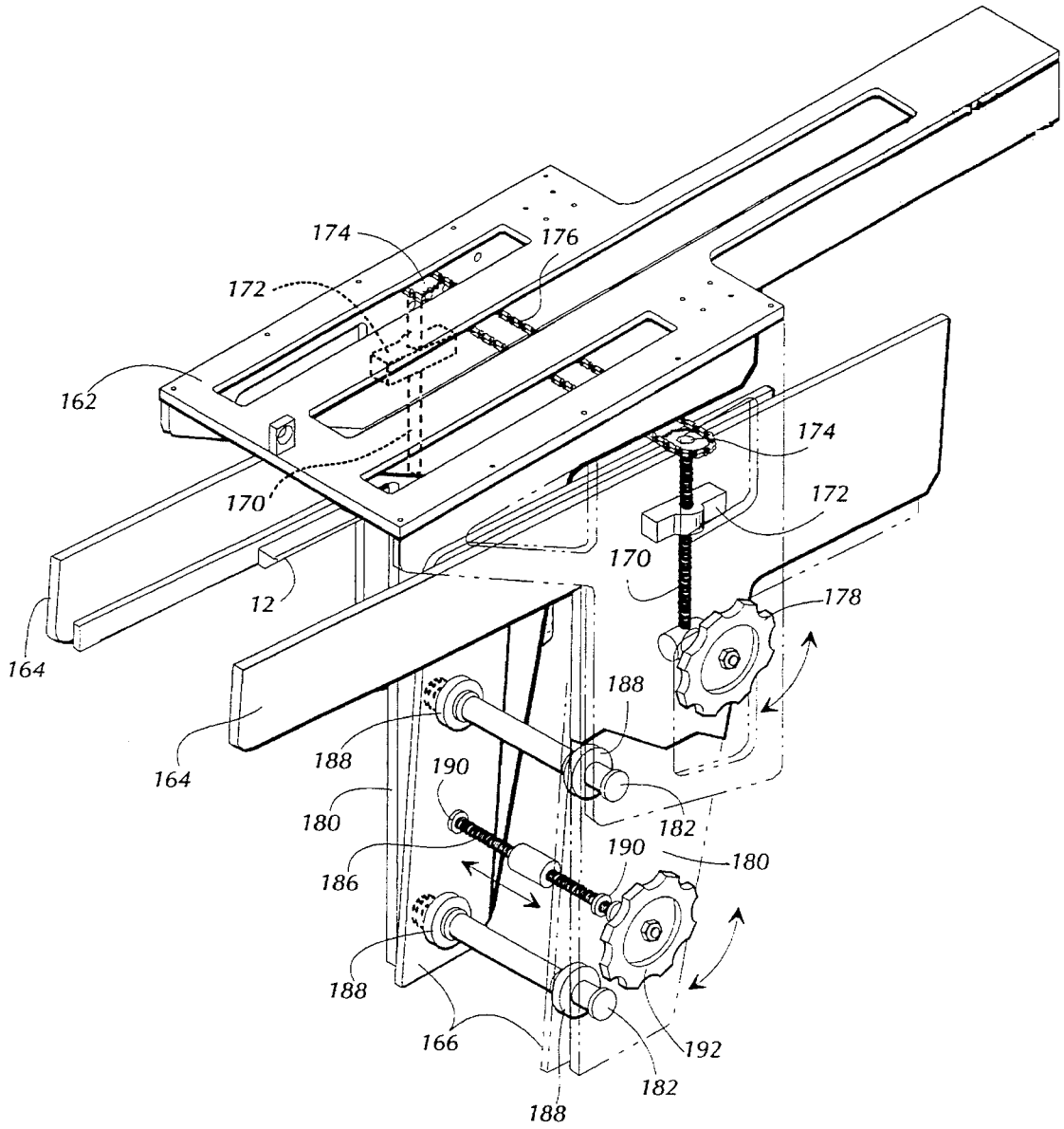
FIG. 10 is a partial perspective view of an adjustment frame.

With reference to FIG. 10, the partition feeder 10 has three nested frames 162, 164, and 166 for supporting and mounting the partition feeder 10 at a specific location relative to a flow of articles. The majority of the elements constituting the partition feeder 10 are mounted to the middle frame 164 with only the guide rails 12 being mounted to the inner frame 166. The middle frame 164 is mounted to the outer frame 162 in manner that allows the vertical adjustment of the partition feeder 10 while the inner frame 166 is mounted to the middle frame 164 in a manner that allows the horizontal adjustment of the partition feeder 10.

More specifically, with regard to the vertical adjustment, each side of the partition feeder 10 has a bolt 170 threaded through a bracket 172 integral with the middle frame 164. An upper end of each bolt 170 is connected to a sprocket 174, which is securely mounted to the outer frame 162. The sprockets 174 are interconnected with a chain 176 so that both bolts 170 will be rotated whenever one of the bolts 170 is rotated. When a knob 178 geared to a lower end of one bolt 170 is rotated, the bolt 170 rotates and causes the bracket 172 to either move up or down along the length of the bolt 170. Thus, depending upon the direction in which the knob 178 is rotated, the bracket 172 and the entire middle frame 164 can be raised or lowered with respect to the outer frame 162.

With regard to the horizontal adjustment of the partition feeder 10, the inner frame 166 is comprised of a pair of vertical plates which are formed between two walls 180 of the middle frame 164. The walls 180 of the middle frame 164 are joined together by two support rods 182 and a bolt 186 which extend through each of the plates 166. The plates 166 are mounted to the support rods 182 through bearings 188 to allow the plates 166 to slide along the support rods 182 and are mounted to the bolt 186 through nuts 190 integral with the plates 166. The two ends of the bolt 186 are threaded in opposite directions so that the rotation of the bolt 186 will cause the plates 166 to move in opposite directions, that is either toward or away from each other. A knob 192 is attached to one end of the bolt 186 to allow an operator to adjust the distance between the plates 166 by rotating the knob 192.

The partition feeder 10 can be easily adjusted for partitions 14 of various sizes. By rotating the knob 192, the distance between the plates 166, and thus the distance between the guide rails 12, can be adjusted to correspond with the widths of the partitions 14. The stack of partitions 14 can then be adjusted vertically with knob 178 to adjust the partition feeder 10 to the height of the partitions 14. These adjustments are easily performed by simply rotating the knobs 178 and 192 and do not require an operator to replace any parts in the partition feeder 10. Since the partition feeder 10 can be adjusted for partitions of different sizes, the partition feeder 10 is not limited to a specific packaging machine but rather can be used to package articles having various sizes and configurations into cartons of different sizes.

It should be understood that the invention is not limited to the partition feeder 10 shown in the figures. For instance, the multi-rack assembly 70 can be designed to hold a greater or lesser number of stacks 72, such as only one reserve stack or four or more reserve stacks. Also, the multi-rack assembly 70 could add a reserve stack 72 of partitions 14 or cartons into a supply hopper when the main stack in the supply hopper has been reduced down to a certain point.

The size and shape of the guide rails 12 may be varied to the particular size and shape of a partition 14. Thus, if the partitions 14 do not have notched sides but instead have another shape of indentation or aperture, the guide rails 12 can be modified to mate with the other indentation or aperture in order to suspend the partitions 14.

Further, the partition feeder 10 may be adjusted in ways other than that shown. For example, the partition feeder 10 may be constructed to have a greater or lesser number of frames which permit the vertical and horizontal adjustment of the guide rails 12. While the adjustments have been described as being performed manually, the adjustments could easily be performed automatically through suitable motors and sensors. Thus, an operator could press a button or otherwise indicate to the PLC 102 that the partition feeder 10 needs to change from one partition size to another partition size and all of the requisite adjustments would be controlled through the PLC 102.

It will further be obvious to those skilled in the art that many variations may be made in the above embodiments, here chosen for the purpose of illustrating the present invention, and full result may be had to the doctrine of equivalents without departing from the scope of the present invention, as defined by the appended claims.

What is claimed is:

1. An apparatus for forming a main stack of products, comprising:

means for forming said main stack of products and for forcing said products against a set of tabs at one end of said main stack, said products being removed at said one end by a selecting apparatus;

means for forming at least one reserve stack of products;

means for moving said one reserve stack of products into alignment with said main stack of products at an end of said main stack opposite said one end and for adding said products in said reserve stack to said main stack; and a controller for causing said moving means to align said reserve stack with said main stack when said main stack has been reduced down to a predetermined amount;

wherein said products comprise partitions having notched sides and said means for forming said main stack comprises a pair of guide rails which are received within said notched sides of said partitions and said means for forming said reserve stack comprises a pair of paddles which are received within said notched sides of said partitions, said partitions being suspended by said guide rails and by said paddles.

2. A multi-rack assembly for forming reserve stacks of products, comprising:

a first drive unit having a first paddle aligned with a first guide rail and a second paddle parallel to said fast paddle and spaced a predetermined distance below said first paddle;

a second drive unit having a third paddle aligned with a second guide rail and a fourth paddle parallel to said third paddle and spaced said predetermined distance below said third paddle;

said first paddle and said second paddle being laterally spaced a certain distance from said third paddle and said fourth paddle, respectively, said certain distance sufficient for a first reserve stack of products to be formed between said first and third paddles and a second reserve stack of products to be formed between said second and fourth paddles;

a controller for generating a control signal when additional products are needed in a main stack formed between said first and second guide rails;

wherein upon receipt of said control signal from said controller, said drive units simultaneously raise said second and fourth paddles into alignment with said first and second guide rails, respectively, whereby products in said second reserve stack of products may be added to said main stack; and wherein said products comprise partitions having notched sides and said first and third paddles are received within said notched sides of said first reserve stack of partitions to suspend said first reserve stack and said second and fourth paddles are received within said notched sides of said second reserve stack of partitions to suspend said second reserve stack.

3. The multi-rack assembly as set forth in claim 2, wherein each of said first and second drive units has three paddles with said drive units successively aligning each of said paddles with said first or second guide rails upon receipt of said control signal.

4. A multi-rack assembly for forming reserve stacks of products, comprising:

a first drive unit having a first set of paddles equally spaced about a periphery of said first drive unit and a first motor for rotating said first set of paddles in a counter-clockwise direction about said periphery;

a second drive unit having a second set of paddles equally spaced about a periphery of said second drive unit and a second motor for rotating said second set of paddles in a clockwise direction about said periphery, said first and second set of paddles having an equal number of paddles;

said paddles in said first and second sets being aligned with each other such that each paddle on an interior side of one of said first or second drive unit is laterally spaced a predetermined distance from a corresponding paddle on an interior side of the other of said first or second drive unit, said interior side being a side of said drive unit which faces the other drive unit;

said predetermined distance being sufficient for each laterally spaced pair of paddle on said interior sides of said first and second drive units to form a reserve stack of products between said first and second drive units;

one of said laterally spaced pair of paddles on said interior sides of said first and second drive units being aligned with, and parallel to, a pair of guide rails with each paddle in said one pair being placed at an end of a respective guide rail; and a controller for generating a control signal to drive said first and second motors in synchronism with each other so as to move said one pair of paddles out of alignment with said first and second guide rails and to move a second pair of laterally spaced paddles into alignment with said first and second guide rails;

wherein said controller generates said control signal and moves said second pair of paddles into alignment with said first and second guide rails when a main stack of products between said first and second guide rails has been reduced down a certain amount; and wherein said products comprises partitions having notched sides and said paddles are wedge shaped which are received within said notched sides of said partitions to thereby suspend each reserve stack between each pair of laterally spaced paddles.

5. The multi-rack assembly as set forth in claim 4, wherein said controller detects said certain amount when said main stack is reduced to a certain thickness.

6. The multi-rack assembly as set forth in claim 4, wherein said controller detects said certain amount by detecting when said main stack is reduced down to a certain weight.

7. The multi-rack assembly as set forth in claim 4, wherein only one full rotation of said first and second motors moves said first pair of paddles out of alignment with said first and second guide rails and moves said second pair of paddles into alignment with said first and second guide rails.

8. The multi-rack assembly as set forth in claim 4, wherein each drive unit comprises:

a drive shaft at one end of each drive unit and a second shaft at an opposite end of each drive unit, said drive shaft and said second shaft being parallel to each other;

a sprocket at each end of said drive shaft and at each end of said second shaft;

a first chain connecting the sprocket at one end of said drive shaft to the sprocket at the one end of said second shaft and a second chain connecting the sprocket at the other end of said drive shaft to the sprocket at the other end of said second shaft;

a first pulley connected to an output of said first or second motor, a second pulley on said drive shaft, and a belt for rotating said first pulley in synchronism with said second pulley.

9. The multi-rack assembly as set forth in claim 8, wherein each paddle is mounted to said first and second chains.

10. The multi-rack assembly as set forth in claim 4, wherein said one pair of paddles comprises an uppermost pair of laterally spaced paddles on said interior sides of said first and second drive units.

11. The multi-rack assembly as set forth in claim 4, wherein said first and second drive units have three pairs of laterally spaced paddles on said interior sides for forming three reserve stacks of products.

12. The multi-rack assembly as set forth in claim 4, wherein said first and second drive units move a subsequent pair of paddles on said interior sides of said drive units into alignment with said first and second guide rails with each subsequent control signal.

13. The multi-rack assembly as set forth in claim 4, further comprising means for detecting said reserve stack of products between said second pair of laterally spaced paddles and wherein said controller advances said second pair of paddles into alignment with said first and second guide rails when said reserve stack of products is detected between said second pair of paddles and when said main stack has been reduced down past said certain amount.

14. A partition feeder for use with partitions having notched sides, comprising:

first and second spaced apart guide rails for respectively receiving said notched sides of said partitions and for forming a main stack of said partitions between said guide rails and along a longitudinal axis of said guide rails;

at least one tab at one end of said guide rails for contacting one end of said stack, said partitions being removed from said one end of said guide rails by a selecting apparatus; and means for biasing said partitions toward said one end of said guide rails;

wherein said guide rails suspend said partitions and allow said partitions to freely advance toward said one end of said guide rails.

15. The partition feeder as set forth in claim 14, wherein a distance between said first and second guide rails is adjustable whereby partitions of varying widths may be suspended on said guide rails.

16. A partition feeder for use with partitions having notched sides, comprising:

first and second spaced apart guide rails for respectively receiving said notched sides of said partitions and for forming a main stack of said partitions between said guide rails and along a longitudinal axis of said guide rails:

at least one tab at one end of said guide rails for contacting one end of said stack, said partitions being removed from said one end of said guide rails by a selecting apparatus; and means for biasing said partitions toward said one end of said guide rails;

wherein said guide rails suspend said partitions and allow said partitions to freely advance toward said one end of said guide rails; and wherein said guide rails have generally planar top surfaces and angled side surfaces with said top surfaces supporting said partitions.

17. An adjustable frame for a partition feeder forming a main stack of partitions between first and second side rails, comprising:

a first frame having first and second walls spaced apart from each other a fixed distance, said first frame mounting at least part of said partition feeder at a specific location relative to a flow of articles;

a second frame comprised of first and second plates positioned between said first and second walls, said first and second side rails being respectively mounted to said first and second plates;

means for mounting said first and second plates to said first and second walls and for allowing said first and second plates to travel between said first and second walls; and means for adjusting a distance between said first and second plates;

wherein said adjusting means is adjusted so that a distance between said first and second side rails corresponds to a width of said partitions;

said adjustable frame further comprising:

a third frame mounted at a predetermined height above said flow of articles; means for attaching said first and second walls to said third frame and for allowing said first and second walls to be raised or lowered with respect to said third frame; and means for varying a distance between said first and second walls and said third frame;

wherein said varying means is varied so that a distance between said third frame and said first and second side rails corresponds to a height of said partitions.

18. The adjustable frame for said partition feeder as set forth in claim 17, wherein said mounting means comprises a support rod extending from said first wall to said second wall and bearings mounted to said first and second plates for traveling along said support rod.

19. The adjustable frame for said partition feeder as set forth in claim 17, wherein said adjusting means comprises:

a bolt extending from said first wall to said second wall and having opposite ends of said bolt reverse threaded;

first and second nuts respectively integral with said first and second plates and threaded onto opposite ends of said bolt; and a knob attached to one end of said bolt;

wherein rotation of said knob causes said first and second nuts to travel in opposite directions and therefore causes said first and second plates to travel in said opposite directions.

20. The adjustable frame for said partition feeder as set forth in claim 17, wherein said attaching means comprises:

a first bracket integral with said first wall and a second bracket integral with said second wall;

a first bolt threaded through said first bracket and having one end fixed to said third frame;

a second bolt threaded through said second bracket and having one end fixed to said third frame;

means for rotating said second bolt upon rotation of said first bolt; and a knob geared to said first bolt such that rotation of said knob causes said first bolt to rotate;

wherein rotation of said knob causes said first and second bolts to rotate and, depending upon a direction of said rotation, to raise or lower said first and second walls relative to said third frame, whereby said first and second side rails are also raised or lowered relative to said third frame.

21. The adjustable frame for said partition feeder as set forth in claim 17, wherein said first and second side rails respectively comprise first and second wedge shaped guide rails which are received within notched sides of said partitions and which suspend said partitions.

22. An adjustable frame for a partition feeder forming a main stack of partitions between first and second side rails, comprising:

a first frame mounted at a predetermined height above a flow of articles;

a second frame having at least said first and second side rails of said partition feeder mounted thereon;

means for attaching said second frame to said first frame and for allowing said second frame to be raised or lowered with respect to said first frame; and means for varying a distance between said first and second frames;

wherein said varying means is varied so that a distance between said first frame and said first and second side rails corresponds to a height of said partitions; and wherein said attaching means comprises:

a bracket integral with said second frame;

a bolt threaded through said bracket and having one end fixed to said first frame;

a knob geared to said bolt such that rotation of said knob causes said bolt to rotate;

wherein rotation of said knob causes said first bolt to rotate and, depending upon a direction of said rotation, to raise or lower said second frame relative to said first frame, whereby said first and second side rails are also raised or lowered relative to said first frame.

23. An adjustable frame for a partition feeder forming a main stack of partitions between first and second side rails, comprising:

a first frame mounted at a predetermined height above a flow of articles;

a second frame having at least said and second side rails of said partition feeder mounted thereon;

means for attaching said second frame to said first frame and for allowing said second frame to be raised or lowered with respect to said first frame; and means for varying a distance between said first and second frames;

wherein said varying means is varied so that a distance between said first frame and said first and second side rails corresponds to a height of said partitions; and wherein said first and second side rails respectively comprise first and second wedge shaped guide rails which are received within notched sides of said partitions and which suspend said partitions.

24. A mass feeder, comprising:

a pair of side rails for forming a main stack of products;

a tab located at one end of said side rails for contacting an end product in said stack, said end product being removed by a selecting apparatus at said one end;

means for forming a number of reserve stacks of products vertically spaced and aligned with each other wherein a top reserve stack is aligned with said main stack;

a first pusher for advancing an opposite end of said main stack as said one end toward said tab;

a second pusher for adding said products in said top reserve stack to said main stack; and a controller;

wherein said controller causes said first pusher to be removed from contact with said main stack when said top reserve stack approaches said main stack and said controller causes said second pusher to advance said main stack toward said tab after the products in said top reserve stack have been added to said main stack.

25. The mass feeder as set forth in claim 24, further comprising:

first and second screw shafts parallel to said side rails;

first and second members for respectively mounting said first and second pushers to said first and second screw shafts; and first and second motors for respectively rotating said first and second screw shafts;

wherein said controller moves said first and second pushers along said first and second screw shafts by driving said first and second motors.

26. The mass feeder as set forth in claim 24, further comprising:

a first rotary actuator for controlling a rotational position of said first pusher;

a second rotary actuator for controlling a rotational position of said second pusher;

a first solenoid valve for connecting said first rotary actuator to a first pneumatic line for raising said first pusher when a first control signal is received and for connecting said first rotary actuator to a second pneumatic line for lowering said first pusher when a second control signal is received;

a second solenoid valve for connecting said second rotary actuator to said first pneumatic line for raising said second pusher when said first control signal is received and for connecting said second rotary actuator to said second pneumatic line for lowering said second pusher when said second control signal is received;

said controller generating said first and second control signals to raise and lower said first and second pushers.

27. The mass feeder as set forth in claim 24, wherein said first and second side rails respectively comprise first and second wedge shaped guide rails which are received within notched sides of said products and which suspend said products.

28. The mass feeder as set forth in claim 24, wherein said means for forming said reserve stacks advances a lower reserve stack of products into alignment with said side rails after the products in said top reserve stack have been added to said main stack.

29. The mass feeder as set forth in claim 24, further comprising means for detecting said reserve stacks of products.

30. The mass feeder as set forth in claim 24, further comprising a photoeye on said first pusher for detecting products in said top reserve stack.

31. The mass feeder as set forth in claim 24, further comprising means for detecting when said first pusher has advanced said main stack to a position where a last product at said opposite end of said stack is a predetermined distance from an end of said side rails.

* * * * *